US006409304B1

(12) United States Patent
Taylor

(10) Patent No.: US 6,409,304 B1
(45) **Date of Patent: *Jun. 25, 2002**

(54) LIQUID CAPPING SYSTEM FOR SEALING INKJET PRINTHEADS

(75) Inventor: Bret K Taylor, Vancouver, WA (US)

(73) Assignee: Heweltt-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/560,800

(22) Filed: Apr. 28, 2000

Related U.S. Application Data

(63) Continuation of application No. 08/838,477, filed on Apr. 7, 1997, now Pat. No. 6,102,518.

(51) Int. Cl.[7] ..... B41J 2/165
(52) U.S. Cl. ..... 347/29; 347/33; 347/28
(58) Field of Search ..... 347/29, 33, 22, 347/28, 32, 31

(56) References Cited

U.S. PATENT DOCUMENTS

| | | | | |
|---|---|---|---|---|
| 4,024,548 A | | 5/1977 | Alonso et al. | 347/34 |
| 4,231,046 A | | 10/1980 | Aiba | 347/44 |
| 4,432,004 A | | 2/1984 | Glattli | 347/28 |
| 4,951,066 A | | 8/1990 | Terasawa et al. | 347/33 |
| 5,051,758 A | | 9/1991 | Markham | 347/28 |
| 5,300,958 A | | 4/1994 | Burke et al. | 347/28 |
| 5,341,160 A | | 8/1994 | Winslow et al. | 347/86 |
| 5,528,271 A | | 6/1996 | Ebisawa | 347/34 |
| 5,614,930 A | | 3/1997 | Osborne et al. | 347/33 |
| 5,801,725 A | | 9/1998 | Neese et al. | 347/32 |
| 5,815,176 A | | 9/1998 | Rotering | 347/33 |
| 5,914,734 A | | 6/1999 | Rotering et al. | 347/28 |
| 6,102,518 A | * | 8/2000 | Taylor | 347/29 |

FOREIGN PATENT DOCUMENTS

| | | | |
|---|---|---|---|
| JP | 6-143597 A | 5/1994 | B41J/2/65 |

* cited by examiner

*Primary Examiner*—John Barlow
*Assistant Examiner*—Shih-Wen Hsieh

(57) ABSTRACT

A liquid capping system for sealing the ink-ejecting nozzles of an inkjet printhead during periods of printing inactivity uses a vicious, inkjet ink compatible, sealing liquid that is applied to the printhead surface to seal the nozzles and prevent the ink in the printhead from drying. An inkjet printing mechanism houses the printhead and has a service station that stores the sealing liquid. To selectively apply the sealing liquid to the printhead, the service station has an applicator mechanism including a dispenser member and a sealing wiper that transfers the sealing liquid from the dispenser member to the printhead. The sealing wiper may also clean the printhead face or be dedicated to only sealing the printhead. A method is provided for sealing an inkjet printhead using a liquid capping system, including the step of spitting the printhead to clear the sealing liquid from the nozzles before returning to printing.

30 Claims, 4 Drawing Sheets

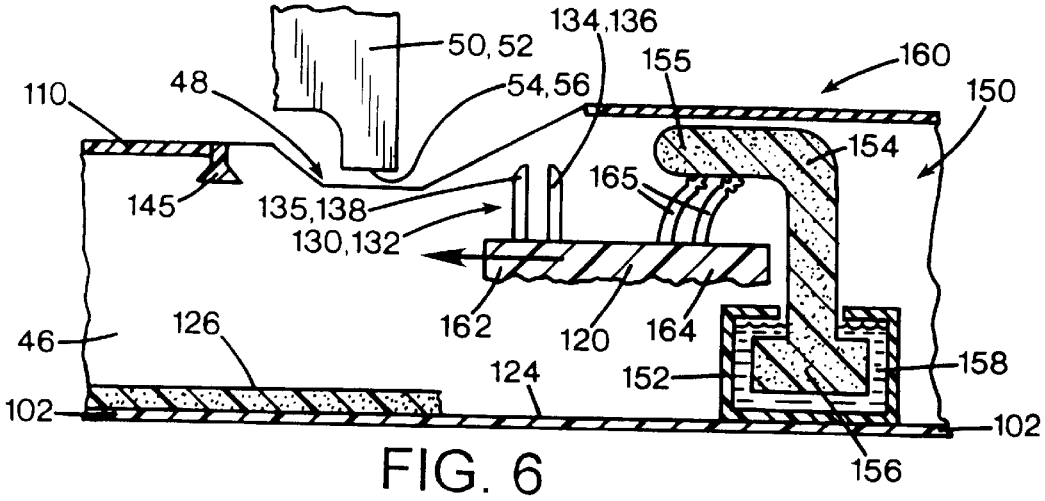
FIG. 6
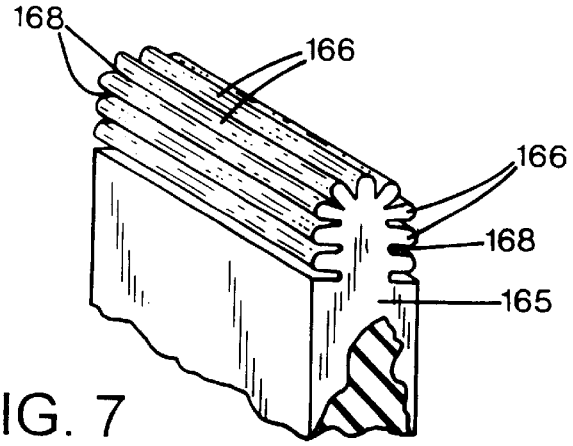
FIG. 7
FIG. 8
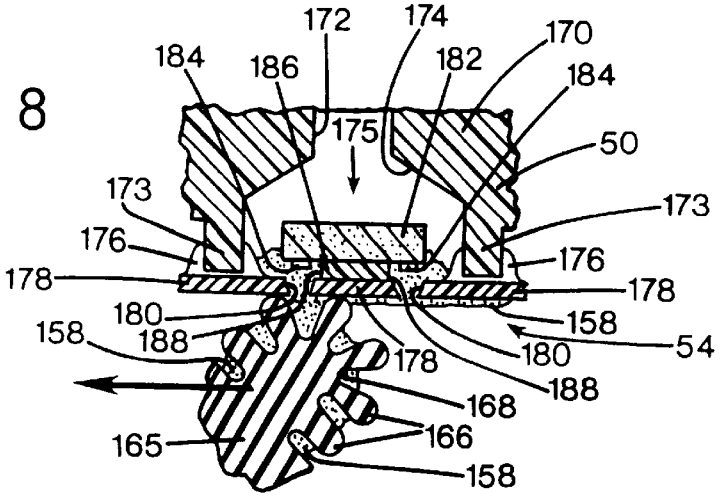

LIQUID CAPPING SYSTEM FOR SEALING INKJET PRINTHEADS

CROSS REFERENCE TO RELATED APPLICATION(S)

This is a continuation of application Ser. No. 08/838,477 filed on Apr. 7, 1997 now U.S. Pat. No. 6,102,518, issued on May 15, 2000.

FIELD OF THE INVENTION

The present invention relates generally to inkjet printing mechanisms, and more particularly to a liquid capping system for sealing an inkjet printhead of an inkjet printing mechanism during periods of printing inactivity.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture chart or text).

To clean and protect the printhead, typically a "service station" mechanism is mounted within the printer chassis so the printhead can be moved over the station for maintenance. For storage, or during non-printing periods, the earlier service stations used a capping system having elastomeric sealing cup with a lip which surrounded the printhead nozzles to form a seal that protects the nozzles from contaminants and from drying. To facilitate priming, some printers had priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations clean the printhead using a flexible wiper that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks which results in a higher optical density for the new inks. Both types of ink dry quickly, which allows inkjet printing mechanisms to use plain paper. Unfortunately, the combination of small nozzles and quick-drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, spitting to clear the nozzles becomes even more important when using pigment-based inks, because the higher solids content contributes to the clogging problem more than the earlier dye-based inks.

In the past, the printhead wipers have typically been a single or dual wiper blade made of an elastomeric material. Typically, the printhead is translated across the wiper in a direction parallel to the scan axis of the printhead, so for a pen having nozzles aligned in two linear arrays perpendicular to the scanning axis, first one row of nozzles was wiped and then the other row was wiped. A revolutionary orthogonal wiping scheme was used in the Hewlett-Packard Company's DeskJet® 850C, 855C, 820C and 870C color inkjet printer models, where the wipers ran along the length of the linear arrays, wicking ink from one nozzle to the next. This wicked ink acted as a solvent to break down ink residue accumulated on the nozzle plate. This product also used a dual wiper blade system, with special contours on the wiper blade tip to facilitate the wicking action and subsequent cleaning.

Challenges were faced in finding suitable capping strategies for the new pigment based inks, while also adequately capping the multi-color dye based printhead. Earlier capping systems placed a sealing chamber around the nozzles to hermetically seal the printhead nozzles in a humidified atmospheric environment that prevented drying or decomposition of the ink during periods of printer inactivity. Once again, the Hewlett-Packard Company's DeskJet® 850C, 855C, 820C and 870C color inkjet printers employed an elastomeric capping chamber with a unique multi-ridged lip to seal the pigment based black pen. As spring-biased rocking sled supported both the black and color caps, and gently engaged the printheads to avoid depriming them. A unique vent system comprising a Santoprene® cap plug and a labyrinth vent path under the sled avoided inadvertent deprimes, while also accommodating barometric changes in the ambient pressure. While the radically new service station first employed in the DeskJet® 850C printer, and later in the DeskJet® 855C, 820C and 870C printer models, addressed a myriad of problems encountered with the new pigment based inks, this service station had drawbacks. For instance, the capping assembly, as well as the priming system, had numerous moving parts so the service station required a series of intricate manufacturing steps for assembly.

SUMMARY OF THE INVENTION

According to one aspect of the present invention, a service station is provided for sealing an inkjet printhead of an inkjet printing mechanism during periods of printing inactivity. The service station has a reservoir with a capping liquid stored in the reservoir. The service station also includes an applicator that transfers the capping liquid from the reservoir to the printhead. In a illustrated embodiment, the service station further includes a sled, while the applicator includes a dispenser that supplies the capping liquid from the reservoir to a sealing wiper. The sealing wiper is supported by the sled to receive the capping liquid from the dispenser when the sled is in a dispensing position and to apply the received capping solution to the printhead through relative movement of the printhead and the sealing wiper. Several other methods of transferring the sealing liquid to the printhead, and preferably, forcing the sealing liquid into the ink-ejecting nozzles of the printhead, are included.

According to another aspect of the present invention, an inkjet printing mechanism may be provided with the service station described above.

According to a further aspect of the present invention, a method of servicing an inkjet printhead of an inkjet printing mechanism during a period of printing inactivity between first and second printing episodes is provided. The method includes the step of following the first printing episode, sealing ink-ejecting nozzles of the printhead with a liquid sealing material during the period of printing inactivity. In a removing step, which occurs before the second printing episode, the liquid sealing material is removed from the printhead nozzles. In an illustrated embodiment the removing step is accomplished by spitting the liquid sealing material form the nozzles, using the same technology that ejects ink from the nozzles during printing.

An overall goal of the present invention is to provide a liquid capping system for an inkjet printing mechanism that facilitates printing of sharp vivid images, particularly when using fast-drying pigment-based, co-precipitating, or dye-based inks by providing fast and efficient printhead sealing.

Another goal of the present invention is to provide a printhead service station for an inkjet printing mechanism that operates faster and more quietly, has fewer parts, requires fewer assembly steps, and thus, to provide a more economical product for consumers.

A further goal of the present invention is to provide a method of sealing an inkjet printhead that is accomplished in a quiet and efficient manner.

BRIEF DESCRIPTION OF THE DRAWINGS

FIGS. 3–5 are partially schematic side elevational views of the liquid capping system of FIG. 2 showing sealing and unsealing of the printhead, with:

FIG. 3 showing dispensing of a sealing liquid;

FIG. 4 showing applying of the dispensed sealing liquid to the printhead; and FIG. 5 showing clearing of the sealing liquid from the printhead before returning to printing.

FIG. 6 is partially schematic side elevational view of a second embodiment of the liquid capping system of FIG. 1.

FIG. 7 is an enlarged perspective view of one form of a sealing liquid applicator of the liquid capping system of FIG. 6.

FIG. 8 is an enlarged, side elevational, sectional view of the liquid capping system of FIG. 6, showing the applicator sealing the printhead nozzles with the sealing liquid.

DETAILED DESCRIPTION OF THE PREFERRED EMBODIMENTS

Figure 1:
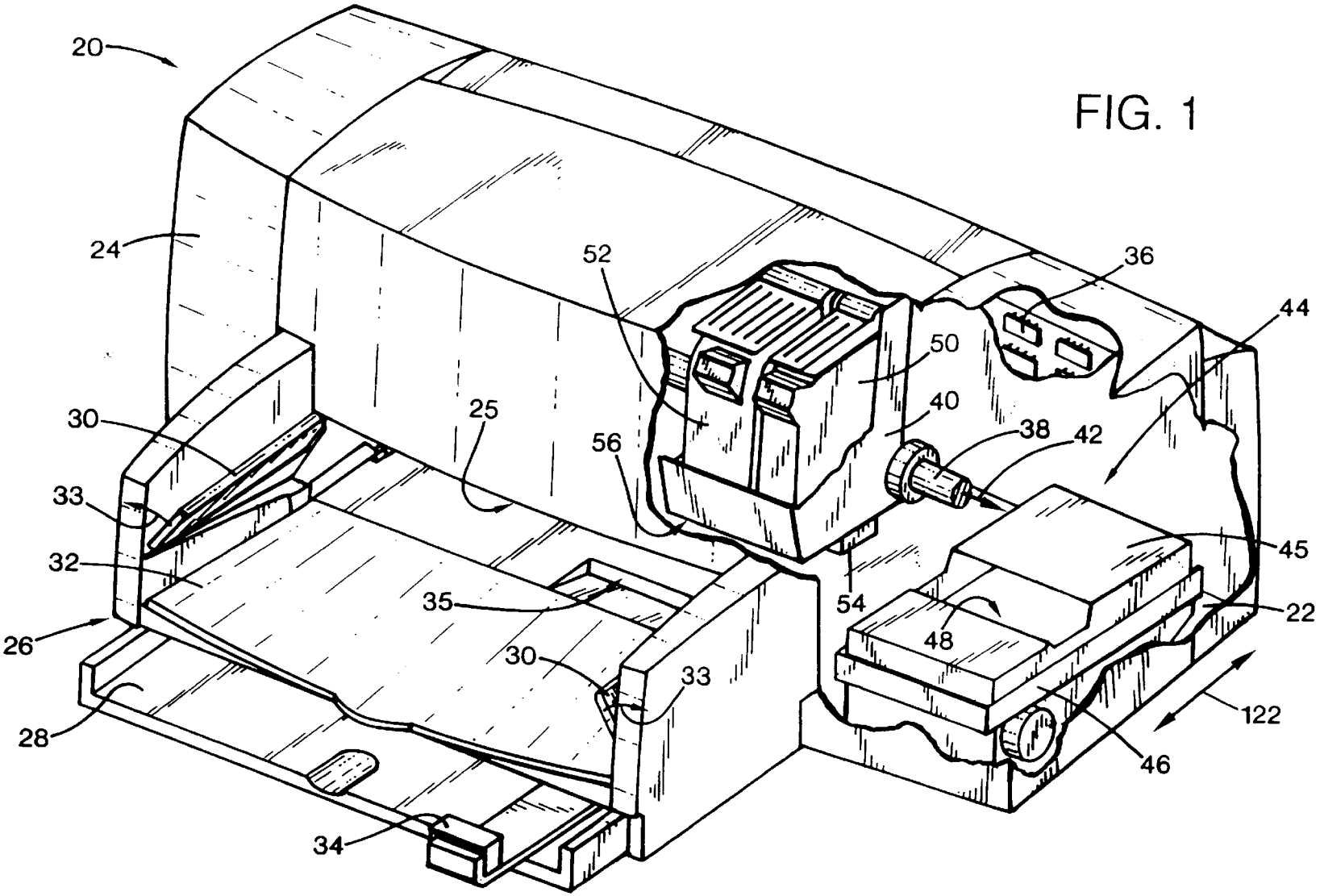
FIG. 1 is a fragmented, perspective view of one form of an inkjet printing mechanism including one form of a liquid capping system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing. After printing, the sheet then lands on a pair of retractable output drying wing members 30, shown extended to receive a printed sheet. The wings 30 momentarily hold the newly printed sheet above any previously printed sheets still drying in an output tray portion 32 before pivotally retracting to the sides, as shown by curved arrows 33, to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and an envelope feed slot 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is supported by the chassis 22 to slideably support an inkjet carriage 40 for travel back and forth across the printzone 25 along a scanning axis 42 defined by the guide rod 38. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 36. For instance, a carriage drive gear and DC motor assembly may be coupled to drive an endless belt secured in a conventional manner to the pen carriage 40, with the motor operating in response to control signals received from the printer controller 36. To provide carriage positional feedback information to printer controller 36, an optical encoder reader may be mounted to carriage 40 to read an encoder strip extending along the path of carriage travel.

The carriage 40 is also propelled along guide rod 38 into a servicing region, as indicated generally by arrow 44, located within the interior of the casing 24. The servicing region 44 houses a service station 45, which may provide various conventional printhead servicing functions. For example, a service station frame 46 holds a group of printhead servicing appliances, described in greater detail below. In FIG. 1, a spittoon portion 48 of the service station is shown as being defined, at least in part, by the service station frame 46.

In the printzone 25, the media sheet receives ink from an inkjet cartridge, such as a black cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. The printheads 54, 56 typically include substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 36 to the printhead carriage 40, and through conventional interconnects between the carriage and pens 50, 52 to the printheads 54, 56.

Preferably, the outer surface of the orifice plates of printheads 54, 56 lie in a common printhead plane. The distance between this plane and the media is known as the media-to-printhead spacing, an important component of print quality. Various appliances of the service station 45 may be adjusted to this common printhead plane for optimum pen servicing. Proper pen servicing not only enhances print quality, but also prolongs pen life by maintaining the health of the printheads 54 and 56.

Liquid Capping System

Figure 2:
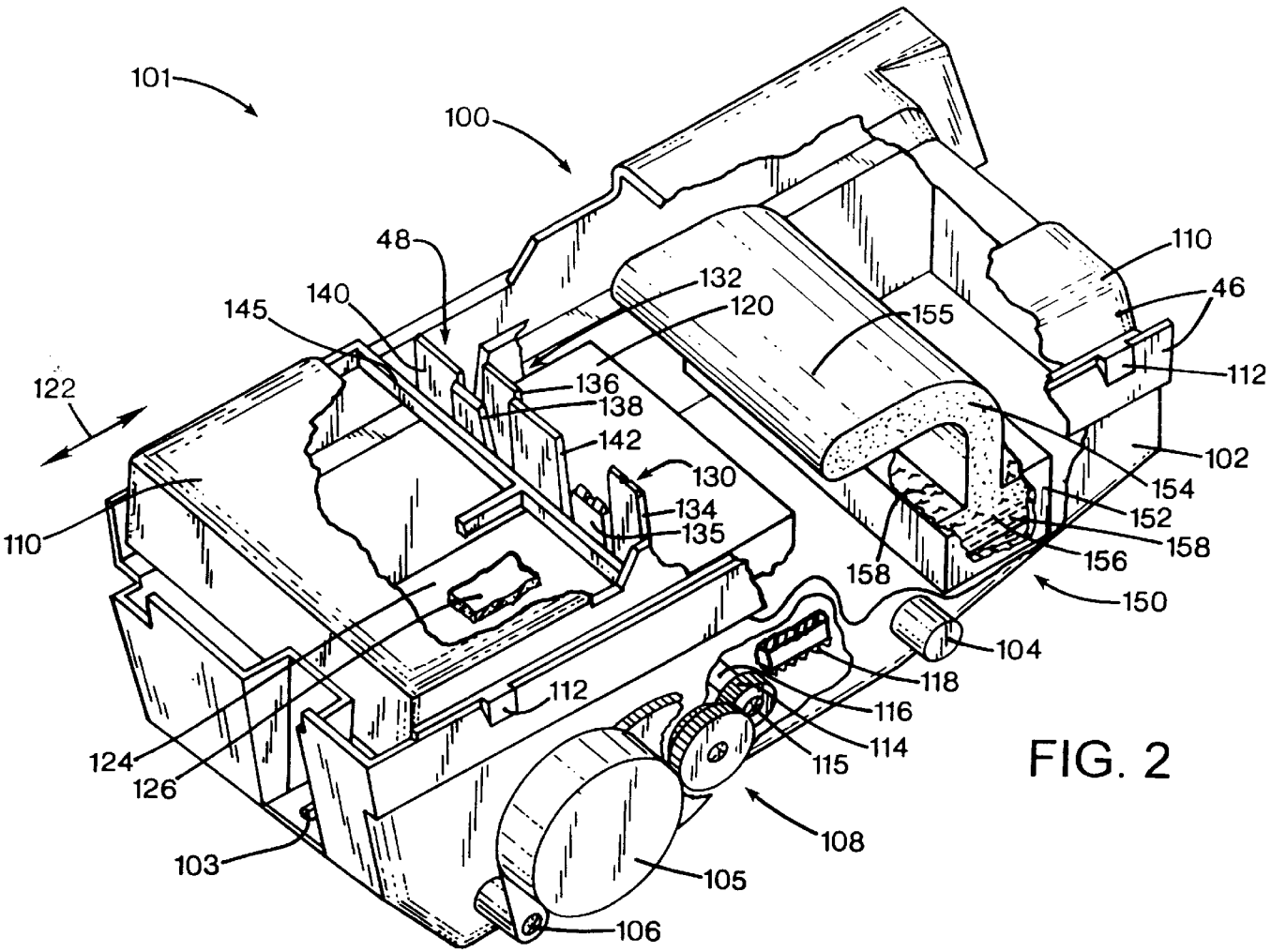
FIG. 2 is a fragmented, perspective view of one form of a service station that houses a first embodiment of the liquid capping system of FIG. 1.

FIG. 2 illustrates a preferred embodiment of a liquid capping system 100 constructed in accordance with the present invention, and here, shown implemented in a transitional service station system 101. The service station frame 46 includes a base member 102 which may be attached to the printer chassis 22, for instance using a snap fastener a rivet, a screw or other fastening device inserted through a slotted hole 103 defined by a front portion of the base 102. To adjust the elevation of the printhead servicing components, an adjustment mechanism (not shown) may be used to engage the frame, for instance using a pair of posts extending outwardly from each side of the frame base 102, such as post 104. As described further below, the frame base 102 also advantageously serves as the spittoon 48, as shown in FIG. 1.

The chassis 22, or more preferably the exterior of the base 102, may be used to support a conventional service station drive motor, such as a stepper motor 105 which receives control signals from the controller 36. Preferably, the motor 105 may be secured to the frame base 102 using a fastener, such as screw 106. The stepper motor 105 is operatively engaged to drive a transfer gear assembly 108, which may include one or more reduction gears, belts, or other drive means known to those skilled in the art to move various service station appliances, described further below into positions to service the printheads 54, 56. Finally, to complete the service station frame 46, an upper portion or bonnet 110 of the frame 46 is secured to the frame base 102, for instance, preferably using molded snap hook assemblies 112 or fasteners, bonding agents, or other means known to those skilled in the art. The transfer gear assembly 108 engages one of a pair of drive gears 114 of a spindle pinion drive gear assembly 115. The pair of pinion gears 114 reside along opposite sides of the service station frame 102, and are coupled together by an axle portion 116. The pair of gears 114 each engage respective pairs of rack gears, such as rack gear 118, formed along a lower surface of a translationally movable pallet 120 to move the pallet 120 in the directions indicated by the double-headed arrow 122.

The pallet 120 may be fully advanced to the front of frame 46 (to the lower left in FIG. 2) in what may advantageously be used during the servicing routine as a home position. The service station drive motor 105 moves the pallet 120 to this home position until the pallet 102 contacts the frame base 102 and no further motion in that direction is possible. At this home position, the logic within the printer controller 36 is reestablished at a zero position. From this zero position, subsequent motor steps are then referenced to locate the pallet 120 for capping, wiping and spitting positions for servicing the printheads 54, 56.

In the illustrated embodiment, the interior of the frame base 102 is substantially enclosed to prevent the escape of ink while serving another role, specifically that of the spittoon 48 to capture ink spit from pens 50, 52. When the pallet 120 is in the home position underneath the front portion of the service station bonnet 110, and the pens 50, 52 are in the servicing position over the service station 101, each printhead 54, 56 has an unobstructed spit-path directly into the spittoon 48. The interior surface of the base 102 defines a spittoon lower surface 124 which may be lined with an absorbent spit pad 126, preferably located beneath the entrance to spittoon 48. The spit pad 126 may be of any type of liquid absorbent material, such as of a felt, pressboard, sponge or other material. One preferred material is an open cell foam sponge material, sold by Time Release Sciences, Inc., 1889 Maryland Ave., Niagara Falls, N.Y. 14305, as type SPR100 material.

The pallet 120 supports black and color printhead wiper assemblies 130, 132 for orthogonally wiping the orifice plates of the respective black and color printheads 54, 56. The illustrated black ink wiper 130 is designed to efficiently clean the black printhead 54 by using two upright spaced-apart, mutually parallel blade portions 134 and 135, each having special tip contours. The color ink wiper assembly 132 may also have two spaced-apart, mutually parallel upright blade portions 136 and 138 for wiping the color printhead 56, here, containing three dye based inks of cyan, magenta, and yellow, for instance. The wiper blades 134–138 may be mounted to the pallet 120 in any conventional manner, such as by bonding with adhesives, sonic welding, or more preferably by onsert molding techniques, where the base of the wiper blade extends through holes defined by the pallet 120. In a preferred embodiment, the wipers and mud flaps are onsert molded onto a sheet of metal, such as a spring steel, which may be bent and formed to provide a wiper mount that may be snap-fitted onto the pallet 120. In the illustrated embodiment, the wiper blades 134–138 are each of a non-abrasive resilient material, such as an elastomer or plastic, a nitrile rubber or other rubber-like material, but preferably of an ethylene polypropylene diene monomer (EPDM), or other comparable material known to those skilled in the art.

In the illustrated embodiment, the black pen 50 contains a pigment based ink which generates a gummy residue that resists wiping using a conventional wiper, as described in the Background portion above. Each of the black wiper blades 134 and 135 terminate in a wiping tip at their distal end. Preferably the wiping tips have a forked geometry, with the number of fork tongs equal to the number of linear nozzle arrays on the corresponding printhead, here two fork tongs for the two linear nozzle arrays of printhead 54. Thus, the wiper blades 134, 135 each have a pair of wiping surfaces at the tips of the fork tongs, with these wiping surfaces being separated by a recessed flat land portion. In the illustrated embodiment, each of the wiper tips are also flanked on their outboard sides by recessed flat land portions. These recessed land portions between and to each side of the wiping tips provide an escape passageway for the gummy, balled-up ink residue to move away from the nozzle arrays during the wiping stroke.

In the illustrated embodiment, both the color wiper blades 136, 138 and the wiper tips of the black blades 134, 135 each have an outboard rounded edge adjacent the outboard surfaces of the blades. Opposite each rounded wiping edge, the wiping tips of blades 134–138 may terminate angularly, or more preferably, in a square edge adjacent the inboard surfaces of the blades. The rounded edges assist in forming a capillary channel between the blade and the nozzle orifice plate to wick ink from the nozzles as the wipers move orthogonally along the length of the nozzle arrays. This wicked ink is pulled by the rounded edge of the leading wiper blade to the next nozzle in the array, where it acts as a solvent to dissolve dried ink residue accumulated on the printhead face plate. The angular edge of the trailing wiper blade then scrapes the dissolved residue from the printhead face plate. That is, when the platform is moving toward the front of the printer (to the left in FIG. 3), the black blade 135 and the color blade 138 are the leading blades wicking ink with their outboard rounded edges, while blades 134 and 136 are the trailing blades, scraping away residue with their inboard angular edges.

The color wiper 132 may be constructed as described above for the black wiper 130, but preferably without the escape recesses. Instead, the color wiper blades 136, 138 each have the arced or rounded edges along their entire outboard width, and a single angular wiping edge along their inboard surfaces. For convenience, all of the wiper black wiper blades 134, 135 and color wiper blades 136, 138 will be referred to herein collectively as wipers 130, 132, unless otherwise noted.

To maintain the desired ink drop size and trajectory, the area around the printhead nozzles must be kept reasonably clean. Some of the earlier wiping systems wiped across the orifice plate and then across areas adjacent the orifice plate, smearing ink along the entire under surface of the printhead. Others wiped only the printhead orifice plate and ignored regions to the sides of the orifice plate. As shown in FIG. 1, the color cartridge 52 has a wider body than the black cartridge 50. The sides of the color cartridge 52 extend straight down to the printhead area, so two wide, flat lands or cheeks are created to each side of the printhead orifice plate 56. In the earlier printers using this style of cartridge, these cheeks were left unwiped. Unfortunately, the cheeks occasionally accumulated ink particles or residue, then bits of dusts, paper fibers and other debris stuck to this residue. Left unwiped, this cheek debris could then be swept across the page during printing. If enough debris had accumulated, it could actually smear the printed ink, degrading print quality.

To address the cheek debris issue, the illustrated service station 101 includes outboard and inboard cheek wiping members, referred to by their designers as "mud flaps" 140, 142, shown in FIG. 2. The mud flaps 140, 142 may be constructed of the same elastomeric material as the wipers 130, 132. Indeed, use of a single type of elastomer for both the wipers 130, 132 and the mud flaps 140, 142 speeds the manufacturing process because the wipers and mud flaps may then be formed or assembled in a single molding step. While the wiper blades 134–138 each have a curved outboard surface, the preferred tip for the mud flaps 140, 142 is rectangular in cross section, having forward and rearward angular wiping edges.

To remove ink residue from the tips of the wipers 130, 132 and the mud flaps 140, 142, the service station bonnet 110 advantageously includes a wiper scraper bar 145, as shown in FIG. 2. The scraper bar 145 has a lower edge which is lower than the tips of wipers 130, 132 and flaps 140, 142. Thus, when the pallet 120 is moved in a forward direction (left in FIG. 2), the wipers 130, 132 and the mud flaps 140, 142 hit the scraper bar 145, and advantageously flick any excess ink at the interior surfaces of the front portions of the bonnet 110 and base 102. This built-in wiper scraper 145 is much more economical that the earlier mechanisms that required elaborate camming mechanisms, intricate scraper arms, and blotter pads that absorbed excess liquids from the ink residue. Following wiping and scraping, the wipers and mud flaps may be hidden under the front shroud of bonnet 110 in the home position, so the wipers and mud flaps are then inaccessible to an operator. The operator is hence protected from becoming soiled by inadvertently touching the wipers 130, 132 and flaps 140, 142.

The function of the wipers 130, 132 described thus far refers to cleaning strokes for cleaning the printheads 54, 56, so when performing this function, the wipers 130, 132 may be referred to as "cleaning wipers." As mentioned in the Background section above, previous systems for sealing the inkjet printheads 54, 56 used an elastomeric sealing cap with lips that contacted the printhead to maintain a humid environment at the nozzles which avoided drying and decomposing inside the printhead. Instead of using such an elaborate sealing system, which often included many moving parts that increased service station assembly costs, both in terms of material costs and labor costs, the present liquid capping 100 system employs a unique new approach to sealing the printheads 54, 56.

As shown in FIG. 2, the liquid capping system 100 includes a sealing liquid dispenser assembly 150. The liquid dispenser 150 includes a reservoir or basin 152, which is illustrated as being supported by the lower surface of the frame 102. An applicator member 154 has an overhanging member 155 that projects upwardly from a base portion 156 of the applicator 154. Here, the applicator base 156 is stationarily supported by, and received within, the reservoir 152. Preferably, the applicator 154 is made of a semi-porous material, for instance, an open-cell thermoset plastic like polyurethane foam, or a medium like sintered polyethylene.

The reservoir 152 holds a sealing fluid, capping liquid or sealant 158, which is preferably a viscous material that is compatible with the inkjet inks, and which may be applied to the printheads 54, 56 to seal the printhead nozzles during periods of printer activity. Preferably, the sealing liquid 158 is also a material that serves as lubricant for the printheads, 54, 56 during wiping strokes to prevent unnecessary abrasion of the printheads and/or wipers. Preferably the sealing liquid 158 is a hygroscopic material, such as polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that function as humectants, absorbing moisture from the air so they will not readily dry out during extended sealing periods. Thus, any leakage of the sealing liquid 158 from the reservoir 152 may be absorbed by the spittoon liner pad 126, which then enhances the absorption properties of the pad 126. After sealing the printheads 50, 52 any previously absorbed water may be released from the hygroscopic material to reduce the rate of evaporation from the nozzles.

One suitable sealing liquid 158 is a PEG compound, preferably having a molecular weight in the range of 100–1000, and more particularly with a molecular weight of around 400. Another suitable sealing liquid 158 is an LEG compound, preferably having a molecular weight selected from the range of 100–1000, and more preferably having a molecular weight of about 300–500. It is apparent that other equivalent highly viscous compounds may also be suitable, such as octanol, terpex derivatives, and low molecular weight hydrocarbon oils. Silicon oils are less likely candidates for the sealing liquid 158 because of their low surface tension.

Sealing fluids 158 that are forced inside the nozzles as preferred, should have a boiling point low enough to allow them to be cleared from the nozzles through spitting. That is, the boiling point should be low enough to allow the sealing fluids to boil when heated by the nozzle firing resistor so a bubble of the fluid will blow out of the nozzle to eject the fluid 158 during a spitting sequence. Highly viscous materials that overlay the orifice plate, rather than being forced into the nozzles, need not have a moderate boiling point.

Of course, the boiling point parameter is not an issue unless thermal inkjet ink technology is used to construct the printheads 54, 56. For instance, in a piezo printhead technology, the viscosity of the sealing liquid 158 may be a determining factor in selecting the sealing liquid composition, rather than the boiling point parameter. Thus, it is apparent that the concepts of the liquid capping system 100 illustrated herein for a thermal inkjet printhead technology may be readily applied to a variety of different printhead technologies.

Figure 3:
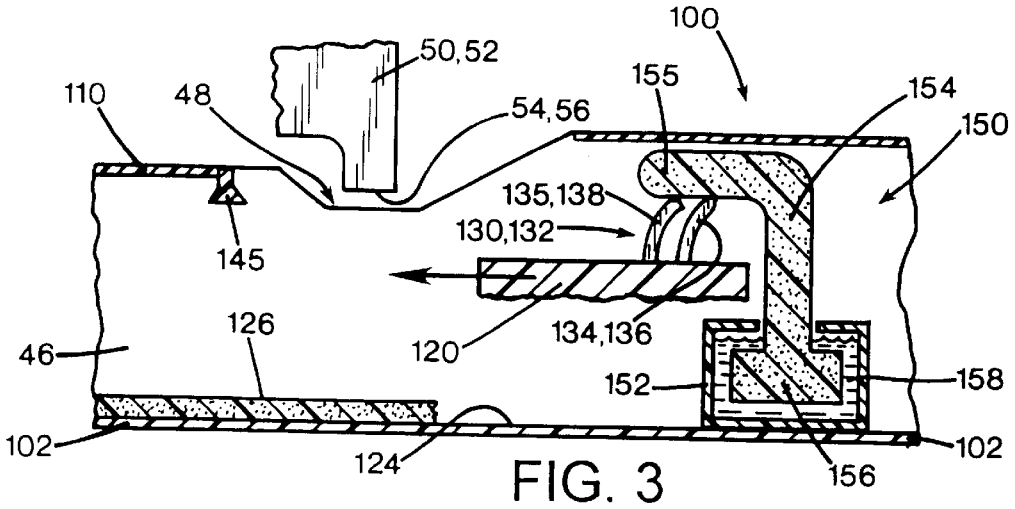

Use of a porous material for the applicator 154 allows the sealing liquid 158 to move from the reservoir 152 upwardly, through capillary action within the interconnected subchambers or channels of the porous material, until reaching the applicator overhang portion 155. As shown in FIG. 3, the applicator overhang 155 has a lower surface which is lower than the tips of the wiper blades 134–138 to create an interference fit between the overhang 155 and blades 134–138 when the pallet 120 has moved the wipers 130, 132 underneath the overhang 155. This interference fit compresses the applicator overhang 155, which in a squeezes out the liquid 158 from the applicator 154, and allows the wipers to collect the sealing liquid 158 along their wiping tips. Note that in FIGS. 3–5, the mud flaps 140, 142 have been omitted from these views for clarity.

Figure 4:
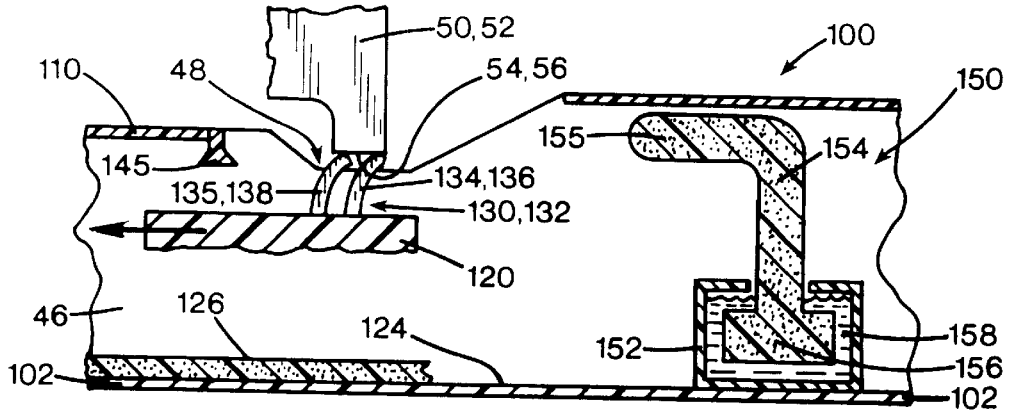

After receiving the sealing liquid from the applicator overhang 155, the service station motor 105 then continues to rotate and move pallet 120 to the left (in FIGS. 2–4), toward the printheads 54, 56. As shown in FIG. 4, upon contacting the printheads 54, 56 the wipers 130, 132 transfer the sealing liquid 158 to the printhead orifice plates, and preferably the flexing wipers also force some of the sealing liquid 158 into the printhead nozzles. Forcing the sealing liquid 158 into the nozzles, and coating the exterior of the orifice plate of the printheads 54, 56 provides a liquid hermetic seal directly at the printhead, which, if left untouched, remains clinging to the orifice plate for a secure seal. Following application of the sealing liquid, as shown in FIG. 4, the pallet 120 may then be stored in the home position underneath the front shroud of bonnet 110. Upon entry into this home position region, the wipers 130, 132 have the sealing liquid 158 scraped off their wiper tips by the scraper bar 145.

Figure 5:
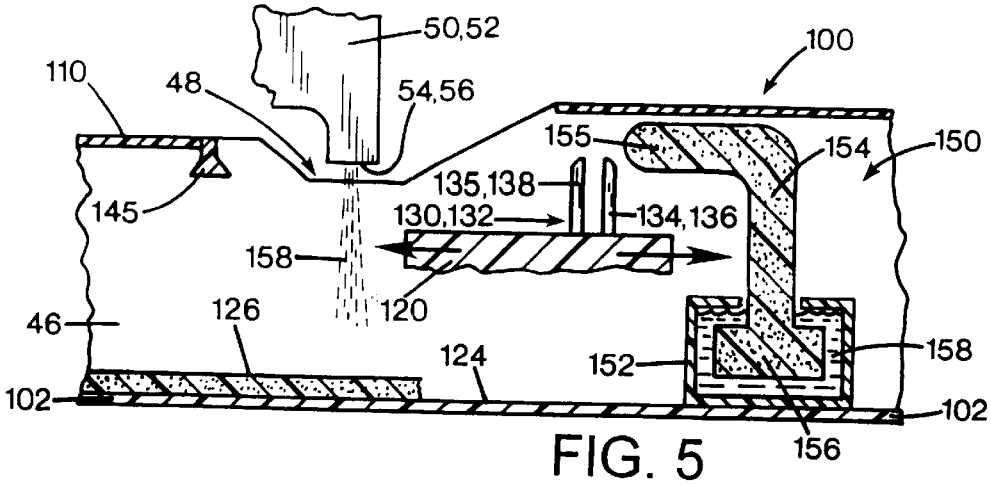

The uncapping portion of the servicing routine is shown in FIG. 5, where the pallet 120 has moved from home position to wipe the bulk of any of the sealing liquid 158 away from the surface of the printheads 54, 56. In FIG. 5, to complete the uncapping portion of the servicing routine, each of the printheads 54, 56 accomplishes a series of spitting routines, to clear the sealing liquid 158 from the nozzles. The number and frequency of the spits may be varied to suit the particular size of nozzle and other design features of the particular printhead. For example, the black pen 50 was found to require on the order of 200 spits to clear a PEG solution from the nozzles.

Using a PEG compound as the sealing liquid 158 has proven to be particularly advantageous when sealing a pigment based ink, such as that dispensed by the black printhead 50 in the illustrated embodiment. Use of the PEG compound is believed to aid in restricting the immigration of pigment particles into the nozzles, a phenomenon which can clog nozzles during extended periods of printer inactivity. Thermal motion or "Brownian motion" tends to move pigment particles from the nozzle filled with more viscous sealing fluid 158 toward the less viscous ink composition in the cartridge 50, 52. Furthermore, the use of PEG as the sealing liquid 158 may also resist the transport of solvent and other molecules, which are components of inkjet ink compositions, to the atmosphere, thereby preventing decomposition of the ink remaining within the pens 50, 52. Additionally, the use of a highly viscous lubricant, such as PEG for the sealing liquid 158 advantageously lubricates the exterior surface of printheads 54, 56 which prevents undue abrasion between wiper blades 134–138 and the orifice plates of printheads 54, 56.

As shown in FIG. 3, the sealing fluid 158 at the tip of the porous material 154 is at a negative pressure since the porous material extends below the tips of wipers 130, 132. However, for the more viscous or high surface energy sealing fluids, the bulk of the porous material may be above where the applicators contact it, leading to a positive pressure for optimum fluid metering.

While the embodiment shown in FIGS. 2–5 shows the wipers 130, 132 serving a dual function, the first as cleaning wipers for cleaning the printheads 54, 56 and the second as sealing wipers capping the printheads 54, 56 when applying the sealing liquid 158 thereto. Using the wipers 130, 132 in this dual function capacity advantageously minimizes the number of parts required to assemble the service station 101; however, performance may be improved by using two separate sets of wipers, one for cleaning and one for capping, to optimize the each of these functions.

FIGS. 6–8 illustrate a second embodiment of a liquid capping system 160, constructed in accordance with the present invention, which separates these two wiper functions. Here, the pallet 120 is equipped with cleaning wipers 130, 132 as described above with respect to FIGS. 2–5, mounted adjacent a front portion 162 of the pallet 120. Along a rear portion 164 of pallet 120, at least one, and optionally two or more capping wipers 165 are mounted. The sealing wipers 165 may be constructed of the same materials described above for the cleaning wipers 130, 132. As shown in FIG. 7, preferably the distal tip of the sealing wiper 165 is formed with a series of ridges 166 separated from one another by grooves 168. The alternating ridges and grooves 166, 168 form lands and recesses, respectively. When receiving the sealing liquid 158 from the applicator 154, the ridges 166 flex, opening the grooves 168 to accumulate a supply of the sealing liquid 158 inside the grooves 168. Upon leaving the applicator overhang 155, the sealing wipers 165 return to an upright rest state, as shown in FIG. 7, from the flexed state shown in FIG. 6. Upon exiting the applicator area, the resilient nature of the ridges 166 also returns the ridges to a rest state shown in FIG. 7, which squeezes some of the sealing liquid 158 from the grooves 168 and onto the tips of ridges 166, where the sealing liquid may then be readily applied to the printheads 54, 56.

FIG. 8 shows a detailed view of the printhead 54 for the black pen 50, to illustrate the step of applying the sealing liquid 158 to the printheads. The printhead 54 is described in U.S. Pat. No. 5,420,627, assigned to the present assignee, the Hewlett-Packard Company, with one commercial embodiment of printhead 54 having approximately three hundred nozzles total, arranged in two mutually parallel linear rays of one hundred and fifty nozzles each. In FIG. 8, the stipple-shaded (small dots) material is the sealing liquid 158, which is shown accumulated in the wiper grooves 168 and being applied to the printhead 54.

The illustrated cartridge 50 has a plastic body 170 that defines an ink feed channel 172, which is in fluid communication with an ink reservoir located within the upper rectangular-shaped portion of the cartridge (shown in FIG. 1). The body 170 also has a raised wall 173 that defines a cavity 174 at the lower extreme of the feed channel 172. An ink ejection mechanism 175 is centrally located within cavity 174, and held in place through attachment by an adhesive layer 176 to a flexible polymer tape 178, such as Kapton® tape, available from the 3M Corporation, Upilex® tape, or other equivalent materials known to those skilled in the art. The illustrated tape 178 serves as a nozzle orifice plate by defining two parallel columns of offset nozzle holes or orifices 180 formed in tape 178 by, for example, laser ablation technology. The adhesive layer 176, which may be of an epoxy, a hot-melt adhesive, a silicone, a uV curable compound, or mixtures thereof, forms an ink seal between the raised wall 173 and the tape 178.

The ink ejection mechanism 175 includes a silicon substrate 182 that contains a plurality of individually energizable thin film firing resistors 184, each located generally behind a single one of the nozzles 180. The firing resistors 184 act as ohmic heaters when selectively energized by one or more enabling signals or firing pulses. These firing pulses are delivered from the controller 36 through a flexible conductor to the carriage 40, and then through electrical interconnects to conductors (omitted for clarity) carried by the polymer tape 178. A barrier layer 186 may be formed on the surface of the substrate 182 using conventional photolithographic techniques. The barrier layer 186 may be a layer of photoresist or some other polymer, which in cooperation with tape 178 defines vaporization chambers 188, each surrounding an associated firing resistor 184. The barrier layer 186 is bonded to the tape 178 by a thin adhesive layer (omitted for clarity from FIG. 8), such as an uncured layer of polyisoprene photoresist. During printing, ink from the supply reservoir flows through the feed channel 172, around the edges of the substrate 182, and into the vaporization chambers 188. When the firing resistors 184 are energized during uncapping, ink within the vaporization chambers 188 is ejected, as well as the sealing liquid 158, as illustrated in FIG. 5.

Thus, in FIG. 8, the sealing liquid 158 is shown being applied to the exterior surface of the tape 178 and being forced into the vaporization chambers 188 preferably to surround the firing resistors 184. Thus, ink within the feed channel 172 is isolated from exposure to atmosphere and atmospheric conditions, to prevent ink drying and decomposition during periods of printer inactivity.

It is apparent that the illustrated translational service station 101 may be replaced by a variety of other service station mechanisms for transferring the sealing liquid 158 from an applicator 154 to the printheads 54, 56. For example, the concepts described herein may be easily adapted to a rotary service station mechanism, such as that commercially available in the DeskJet® inkjet printer models 850C, 855C, 820C and 870C, manufactured by the Hewlett-Packard Company of Palo Alto, Calif. Indeed, a variety of different mechanisms may be used to apply the sealing liquid to the printheads 54, 56. The use of a reciprocating printhead is shown only by way of example, since the concepts illustrated by the liquid capping system 100 may also be used in a page-wide array of printhead nozzles. In such a page-wide array liquid capping system, the sealing liquid 158 may be applied by moving an applicator directly into contact with the orifice plate, or through the use of an intermediate applicator device, such as a wiper, using the principles described above for a translational service station 101.

Thus, in operation, method of servicing the printheads 54, 56 may begin after printing when the pens 50, 52 return to the servicing position over station 101. At this time, spitting into spittoon 48 followed by cleaning wiper strokes may be performed to remove any residue accumulated during the preceding printing episode. Following this routine spitting and/or wiping step, the wipers 130, 132 may be cleaned of any ink residue by passing them under scraper 145, after which the pallet 120 then moves to position the wipers 130, 132 or 165 underneath the applicator overhang 155. Upon exiting the applicator region, the wipers 130, 132 or 165 then move to apply sealing liquid 158 to the printheads 54, 56, as shown in FIGS. 4 and 8. Following application of the sealing liquid, the pallet 120 may then move to the home position underneath the front shroud portion of bonnet 110, leaving the printheads 54. 56 hermetically sealed while the printer 20 is inactive. Upon receiving a signal to print, controller 36 begins the uncapping portion of the servicing routine. The uncapping sequence is illustrated by FIG. 5, where the sealing liquid 158 is spit from the printheads 54, 56 preceded by, or interspersed with, and preferably followed by, one or more cleaning strokes of wipers 130, 132. After clearing the sealing liquid 158 from the printhead, followed by a final wiping step, the pens 50, 52 are ready to return to printing activity.

Alternatively, the dispensing system 150 may be repositioned in the service station frame 46 to be outboard the other servicing appliances, e.g. to the far right in FIG. 1, so the printheads 54, 56 may move directly over the top surface of the applicator overhang 155. In this embodiment, the printheads 54, 56 would compress the applicator 154 squeezing the applicator to extract the sealing liquid 158 from the upper surface of the overhang 155, so sealing liquid may be directly applied without the use of the intermediate wiping members 130, 132, 165. One drawback of such a system would be the overall increase in the width of printer 20, because the length of the scanning path along the carriage guide rod 38 (FIG. 1) would have to be increased, but this factor may not be a problem in other implementations, where the size of the printing mechanism is not of concern. In another alternate embodiment, the dispensing system 150 may be mounted on the service station pallet 120 to selectively move the applicator 154 under the printheads 54, 56 for applying the sealing liquid without the using an intermediate applicator member, such as wipers 130, 132 or 165. Indeed, rather than applying the sealing liquid 158 to the printheads 54, 56 through relative motion between the applicator 154 and the printheads, the sealing liquid 158 may be applied to the printheads by a spraying action, for instance. It is apparent that a variety of modifications may be made to accommodate different sizes and styles of printing mechanisms and inkjet printheads, using the concepts illustrated herein to seal the printhead with a liquid sealing material during periods of printing inactivity. As an alternative to the hygroscopic materials for the sealing liquid 158, it may be preferable to use a hydrophobic oil that would not absorb moisture and not be susceptible to drying; however, a priming operation may be required to remove the hydrophobic oil from the nozzles, in addition to, or instead of, spitting to clear the nozzles.

ADVANTAGES

Several advantages are realized using the liquid capping system illustrated herein. One significant advantage is the decreased number of service station parts, provided by the elimination of the traditional mechanical capping assembly. One of the particular advantages of the embodiment shown in FIGS. 2–5 is a further reduction in the number of parts required in the service station assembly when one set of wipers is used for both cleaning the printhead and for capping the printhead using sealing liquid 158. When a separate set of cleaning wipers 130, 132 is used in conjunction with one or more separate sealing wipers 165, all of these wipers 130, 132 and 165 may be molded to the pallet 120 in a single manufacturing step, for instance using onsert molding techniques. Furthermore, using a dedicated sealing wiper 165 in addition to the cleaning wipers 130, 132 allows each wiper to have a custom contour that enhances performance of both the cleaning and capping tasks.

I claim:

1. A service station for sealing ink ejecting nozzles of an inkjet printhead of a printing mechanism during periods of printing inactivity, comprising:

a reservoir;

a capping liquid stored in the reservoir; and an applicator that transfers the capping liquid from the reservoir to the printhead and seals the printhead nozzles with the capping liquid by forcing the capping liquid into the nozzles and leaving the capping liquid clinging to the printhead to avoid evaporation of ink components from the printhead.

2. A service station according to claim 1 wherein the applicator comprises a porous member and a wiper, with the porous member transferring the capping liquid from the reservoir to the wiper, and with the wiper forcing the capping liquid into the printhead nozzles when transferring the capping liquid to the printhead.

3. A service station according to claim 2 wherein:

the printhead comprises a thermal inkjet technology which ejects ink for printing by heating the ink to a boiling point; and the capping liquid has a boiling point that allows the thermal inkjet technology of the printhead to eject the capping liquid from the nozzles by heating the capping liquid.

4. A service station according to claim 1 wherein the applicator transfers the capping liquid to the printhead through relative movement of the printhead and the applicator.

5. A service station according to claim 4 wherein:

the service station further includes a sled moveable between a dispensing position and another position; and the applicator comprises:

a dispenser that supplies the capping liquid from the reservoir; and a sealing wiper supported by the sled to receive the capping liquid from the dispenser when the sled is in the dispensing position and to apply the received capping solution to the printhead through relative movement of the printhead and the sealing wiper.

6. A service station according to claim 5 wherein:

the sled is also moveable to a servicing position; and the service station further includes a printhead servicing appliance supported by the sled to service the printhead when the sled is in the servicing position.

7. A service station according to claim 6 wherein the printhead servicing appliance comprises a cleaning wiper that services the printhead by wiping ink residue from the printhead through relative movement of the printhead and the cleaning wiper.

8. A service station according to claim 7 wherein:

the sled is also moveable to a wiper scraping position; and the service station further includes a wiper scraper that, through relative movement of the scraper and the cleaning wiper, scrapes ink residue from the cleaning wiper.

9. A service station according to claim 5 wherein:

the sled is also moveable to a servicing position; and the sealing wiper also services the printhead by wiping ink residue from the printhead through relative movement of the printhead and the sealing wiper.

10. A service station according to claim 5 wherein the sealing wiper has an applicator end that contacts the printhead when forcing the capping liquid into the printhead nozzles, with the applicator end having plural lands and recesses, and with the recesses configured to receive the capping liquid therein from the dispenser and to force the capping liquid into the printhead nozzles.

11. A service station according to claim 10 wherein the recesses of the applicator end of the sealing wiper each comprise a groove, and the lands each comprise a ridge.

12. A method of servicing an inkjet printhead of a printing mechanism during a period of printing inactivity between first and second printing episodes, comprising the steps of:

following the first printing episode, sealing ink-ejecting nozzles of the printhead with a capping liquid during the period of printing inactivity by forcing the capping liquid into the nozzles and leaving the capping liquid clinging to the printhead to avoid evaporation of ink components from the printhead; and before the second printing episode, removing the capping liquid from the printhead nozzles.

13. A method according to claim 12 wherein the sealing step comprises forcing the capping liquid into the printhead nozzles using a wiper.

14. A method according to claim 12 wherein the removing step comprises spitting the capping liquid from the printhead nozzles.

15. A method according to claim 14 wherein:

the printhead comprises a thermal inkjet technology:

the first and second printing episodes comprise the step of ejecting ink for printing by heating the ink to a boiling point using said thermal inkjet technology;

the capping liquid has a boiling point that allows said thermal inkjet technology to eject the capping liquid from the nozzles by heating the capping liquid; and the removing step comprises spitting the capping liquid from the printhead nozzles by heating liquid sealing material using said thermal inkjet technology.

16. A method according to claim 12 wherein the sealing step comprises applying the capping liquid to an intermediate member, and through relative motion of the intermediate member and the printhead, transferring at least some of the capping liquid from the intermediate member to the printhead.

17. A method according to claim 16 wherein the relative motion of the intermediate member and the printhead comprises moving the intermediate member.

18. A method according to claim 17 wherein the relative motion of the intermediate member and the printhead comprises moving the intermediate member translationally.

19. A method according to claim 16 wherein the applying step comprises applying the capping liquid to an intermediate member comprising a wiper.

20. A method according to claim 19 wherein the method further includes the step of cleaning the printhead with the wiper through relative motion of the wiper and the printhead.

21. A method according to claim 19 wherein the method further includes the step of cleaning the printhead with a cleaning wiper through relative motion of the cleaning wiper and the printhead.

22. A method according to claim 12, further including the steps of:

storing the capping liquid in a reservoir; and before the sealing step, moving the capping liquid from the reservoir to a dispensing portion of an applicator through capillary action.

23. A method according to claim 22 wherein:

the applicator is of a capillary action inducing material, with the applicator having a base portion extending into the reservoir to absorb the capping liquid therein; and the moving step comprises moving the capping liquid through capillary action within the applicator to move the absorbed capping liquid from the applicator base portion to the applicator dispensing portion.

24. A method according to claim 22 wherein the sealing step comprises applying the capping liquid to an intermediate member, and through relative motion of the intermediate member and the printhead, transferring at least some of the capping liquid from the intermediate member to the printhead.

25. A printing mechanism, comprising:

an inkjet printhead having ink-ejecting nozzles; and a service station for sealing the printhead nozzles during periods of printing inactivity, with the service station including:

a reservoir;

a capping liquid stored in the reservoir; and an applicator that transfers the capping liquid from the reservoir to the printhead and seals the printhead nozzles with the capping liquid by forcing the capping liquid into the nozzles and leaving the capping liquid clinging to the printhead to avoid evaporation of ink components from the printhead.

26. A printing mechanism according to claim 25 wherein:

the printhead has plural nozzles which eject inkjet ink therefrom during printing; and the service station further includes a wiper which forces the capping liquid into the printhead nozzles when transferring the capping liquid to the printhead.

27. A printing mechanism according to claim 26 wherein:

the printhead comprises a thermal inkjet technology which ejects ink for printing by heating the ink to a boiling point; and the capping liquid has a boiling point that allows the thermal inkjet technology of the printhead to eject the capping liquid from the nozzles by heating the capping liquid.

28. A printing mechanism according to claim 25 wherein the applicator transfers the capping liquid to the printhead through relative movement of the printhead and the applicator.

29. A printing mechanism according to claim 28 wherein:

the service station further includes a sled moveable between a dispensing position and another position; and the applicator comprises:

a dispenser that supplies the capping liquid from the reservoir; and a sealing wiper supported by the sled to receive the capping liquid from the dispenser when the sled is in the dispensing position and to apply the received capping solution to the printhead through relative movement of the printhead and the sealing wiper.

30. A printing mechanism according to claim 29 wherein:

the sled is also moveable to a servicing position; and the service station further includes a cleaning wiper supported by the sled to service the printhead by wiping ink residue from the printhead through relative movement of the printhead and the cleaning wiper.

* * * * *